US010427914B2

(12) United States Patent
Zhang et al.

(10) Patent No.: US 10,427,914 B2
(45) Date of Patent: Oct. 1, 2019

(54) ELEVATOR SYNCHRONOUS DOOR KNIFE

(71) Applicant: Otis Elevator Company, Farmington, CT (US)

(72) Inventors: XiaoBo Zhang, HangZhou (CN); QingXi Cai, HangZhou (CN); XiaoXiao Dong, HangZhou (CN); Chong Chen, HangZhou (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 230 days.

(21) Appl. No.: 15/548,239

(22) PCT Filed: Jan. 12, 2016

(86) PCT No.: PCT/US2016/012935
§ 371 (c)(1),
(2) Date: Aug. 2, 2017

(87) PCT Pub. No.: WO2016/130252
PCT Pub. Date: Aug. 18, 2016

(65) Prior Publication Data

US 2018/0265332 A1 Sep. 20, 2018

(30) Foreign Application Priority Data

Feb. 13, 2015 (CN) ..... 2015 1 0078445

(51) Int. Cl.
*B66B 13/12* (2006.01)

(52) U.S. Cl.
CPC ..... *B66B 13/12* (2013.01)

(58) Field of Classification Search
CPC ..... B66B 13/12; B66B 13/20; B66B 13/24
See application file for complete search history.

(56) References Cited

U.S. PATENT DOCUMENTS 4,947,964 A * 8/1990 Husmann ..... B66B 13/12 187/319
5,246,089 A * 9/1993 Husmann ..... B66B 13/12 187/319
5,730,254 A * 3/1998 Nguyen ..... B66B 13/12 187/325

(Continued)

FOREIGN PATENT DOCUMENTS

CN 102923554 A 2/2013
CN 103935873 A 7/2014

OTHER PUBLICATIONS

International Search Report and Written Opinion for application PCT/US2016/012935, dated May 3, 2016, 10pgs.

*Primary Examiner* — Michael A Riegelman
(74) *Attorney, Agent, or Firm* — Cantor Colburn LLP

(57) ABSTRACT

A synchronous door knife includes a track frame and a bottom plate, the back of the bottom plate is hinged with a stop arm, a transmission arm and a lock plate, a front end of the stop arm is provided with a guide wheel, upper and lower portions of the front of the bottom plate are respectively hinged with rotating arms, the upper rotating arm is linked with the transmission arm through a draw bar, one end of the rotating arms is hinged with a first blade, the other end is hinged with a movable plate, the movable plate is hinged with unlock rotating arms, one end of the unlock rotating arms is hinged with a second blade, and the other end abuts against the lock plate.

10 Claims, 5 Drawing Sheets

(56) References Cited

U.S. PATENT DOCUMENTS

| | | | | |
|---|---|---|---|---|
| 5,819,877 | A * | 10/1998 | Rivera | B66B 13/12 187/314 |
| 5,950,766 | A * | 9/1999 | Oberleitner | B66B 13/12 187/319 |
| 6,021,871 | A * | 2/2000 | Grabner | B66B 13/12 187/335 |
| 6,173,815 | B1 * | 1/2001 | Mittermayr | B66B 13/12 187/309 |
| 2005/0126861 | A1 * | 6/2005 | Bisang | B66B 13/12 187/319 |
| 2005/0139429 | A1 * | 6/2005 | Bisang | B66B 13/12 187/319 |
| 2005/0145442 | A1 * | 7/2005 | Cocher | B66B 13/12 187/333 |
| 2006/0107785 | A1 * | 5/2006 | Zappa | B66B 13/20 74/612 |
| 2006/0243535 | A1 * | 11/2006 | Kinoshita | B66B 13/12 187/319 |
| 2012/0118676 | A1 * | 5/2012 | Utsunomiya | B66B 13/12 187/330 |
| 2013/0048433 | A1 * | 2/2013 | Tantis | B66B 13/12 187/319 |
| 2015/0203329 | A1 * | 7/2015 | Zappa | B66B 13/125 187/319 |
| 2015/0329326 | A1 * | 11/2015 | Mittermayr | B66B 13/12 187/330 |
| 2016/0130116 | A1 * | 5/2016 | Kitazawa | B66B 13/12 187/335 |
| 2016/0236907 | A1 * | 8/2016 | Zhang | B66B 13/12 |
| 2017/0130486 | A1 * | 5/2017 | Zappa | B66B 13/06 |
| 2017/0217732 | A1 * | 8/2017 | Kitazawa | B66B 13/20 |
| 2018/0265332 | A1 * | 9/2018 | Zhang | B66B 13/12 |
| 2019/0084806 | A1 * | 3/2019 | Bosshart | B66B 13/16 |

* cited by examiner

ELEVATOR SYNCHRONOUS DOOR KNIFE

TECHNICAL FIELD

The present invention relates to the field of an elevator technology, and in particular, to an elevator synchronous door knife which has a simple structure, is easy to debug and is not easy to crash.

RELATED ART

The door knife type of vertical elevators is divided into two types, i.e., a synchronous type and an asynchronous type, good appearance effects brought about by synchronous door knives due to synchronization of hall car doors are favored by users, but the synchronous door knives put forward higher requirements for mounting and debugging. Such door knives require electrical matching when implementing a function of blocking mechanical reopening of a landing door, and when the function is implemented, crash may occur or at least poor experience will be brought about to the users.

The synchronous door knife of the existing integrated car door usually has three blades, which can be divided into a door opening blade, a door closing blade and an unlock blade according to different directions of motion, the unlock blade is hinged onto the door opening blade, and is between the other two blades. However, such a structure has some defects, one is that the door cannot be opened when a landing door ball is offset-mounted away from the unlock blade, in addition, even if the landing door ball is not offset-mounted, mechanical reopening of the landing door at the end of door closing will require a too long time or the landing door will crash, which greatly reduces comfort of the elevator.

For example, for a patent of which the application number is 201420145370.X and the title is SYNCHRONOUS DOOR KNIFE DEVICE WITH CAR DOOR LOCK FOR ELEVATOR, its structure is: including a door knife bottom plate mounted on a door motor of an elevator; a first blade and a second blade movably mounted on the door knife bottom plate and linked with each other; a transmission arm rotationally connected onto the door knife bottom plate and linked with a door motor driving mechanism, used to drive opening and closing of the first blade and the second blade; a lock plate connected onto the door knife bottom plate by a shaft, and having a lock tongue fitting in with a locking member on the door motor; an unlock transmission arm hinged with the second blade, and abutting against the lock plate to drive the lock plate to be unlocked; and an unlock blade located between the first blade and the second blade, and hinged with the unlock transmission arm. The patent has the aforementioned disadvantages, the door cannot be opened when a landing door ball is offset-mounted away from the unlock blade, in addition, even if the landing door ball is not offset-mounted, mechanical reopening of the landing door at the end of door closing will require a too long time or the landing door will crash, which greatly reduces comfort of the elevator.

SUMMARY OF THE INVENTION

The present invention mainly solves the problems in the prior art that a general synchronous door knife has an unreasonable structure, is not easy to debug, takes a long time to open the door, and is easy to get stuck, and provides an elevator synchronous door knife which has a simple structure, is easy to debug and is not easy to crash.

The aforementioned technical problem of the present invention is mainly solved through the following technical solution: an elevator synchronous door knife, including a track frame disposed on a door motor back plate and a bottom plate disposed on a hanging plate, wherein the back of the bottom plate is hinged with a stop arm, a transmission arm linked with a door motor driving mechanism and a lock plate buckled with a lock hook disposed on a lift car, a front end of the stop arm is provided with a guide wheel fitting in with the track frame, upper and lower portions of the front of the bottom plate are respectively rotationally connected with an upper rotating arm and a lower rotating arm, the upper rotating arm is linked with the transmission arm through a draw bar, one end of the upper rotating arm and the lower rotating arm is movably connected with a first blade, the other end of the upper rotating arm and the lower rotating arm is hinged with a movable plate, to form a four-bar linkage, upper and lower portions of the movable plate are respectively movably connected with an upper unlock rotating arm and a lower unlock rotating arm, the upper unlock rotating arm and the lower unlock rotating arm are movably connected with a second blade, and the upper unlock rotating arm further abuts against the lock plate to drive the lock plate to be unlocked or locked up. The present invention integrates a door closing blade and an unlock blade in a general synchronous door knife structure onto one blade, and simplifies a mechanical structure, thus reducing the requirement for precision of adjusting matching positions of a door knife and a landing door ball, to make debugging much easier. In addition, the problem that the time is too long or crash occurs when mechanical reopening of a landing door is blocked at the end of door closing is also solved. In the present invention, the unlock blade is removed, and the second blade is connected with the unlock rotating arm, and simultaneously plays a role of driving the unlock rotating arm to rotate.

As one preferred solution, in a horizontal direction, a sequence of positions from the first blade to the second blade is kept consistent with a door opening direction. The door opening direction is a direction in which the door plate moves when the door of the elevator is opened, and an advantage of keeping a sequence of positions from the first blade to the second blade consistent with a door opening direction in a horizontal direction is as follows: as the second blade has a function of an unlock blade, normal opening and closing of the door are not affected no matter how the landing door ball is offset-mounted. Specifically, for example, when the landing door ball is offset-mounted close to the unlock blade, the car door lock is unlocked in advance during clamping of the door knife, then the car door is opened first, the landing door is motionless, and finally the door knife is completely clamped so as to be opened together with the landing door; when the landing door ball is offset-mounted away from the unlock blade, the landing door lock is unlocked in advance during clamping of the door knife, then the landing door is opened first, the car door is motionless, and finally the door knife is completely clamped so as to unlock the car door lock to be opened together with the landing door.

As one preferred solution, the movable plate is located below the second blade, an upper portion and a middle portion of one side of the movable plate towards the first blade project respectively to form connecting portions, the other side of the movable plate is provided with several first limit shafts along an edge, the upper unlock rotating arm and the lower unlock rotating arm are respectively rotationally connected onto the two connecting portions, the connecting portions are further provided thereon with second limit shafts, and the upper rotating arm and the lower rotating arm are respectively rotationally connected onto a middle portion and a lower portion of one side of the movable plate away from the first blade. The connecting portions are respectively disposed in the upper portion and lower positions of the middle portion of the movable plate, the whole movable plate forms an F shape, and the connecting portions are connected with the other end of the unlock rotating arm. One end of the two rotating arms is respectively hinged to a lower position of the middle portion and the lower portion of the movable plate. The movable plate links the rotating arms with the unlock rotating arm, so that rotation of the rotating arms also drives the unlock rotating arm to move, to fit in with movement of the second blade, thereby jointly driving the unlock rotating arm so as to unlock the lock plate.

As one preferred solution, the upper unlock rotating arm and the lower unlock rotating arm are both in a shape of an inverted triangle, the connecting portions are rotationally connected onto vertex angles of the inverted triangles, the second blade is rotationally connected onto a corner of the inverted triangles located on an inner side, the other corner of the inverted triangle of the upper unlock rotating arm extends to the lock plate, a rotating wheel is connected onto the corner, and the rotating wheel is in contact with the lock plate. The second blade and the movable plate jointly drive the unlock rotating arm to rotate, so that one end where the unlock rotating arm is in contact with the lock plate sticks up, and the lock plate rotates to be disconnected from the lock hook.

As one preferred solution, the transmission arm is L-shaped, a rear end of the transmission arm is hinged to the back of the bottom plate, a front end of the transmission arm is provided with an arm shaft, the arm shaft is linked with the door motor driving mechanism, a front end head of the transmission arm is provided thereon with a bayonet buckled with the front end of the stop arm, and a first reset spring is connected between the front end of the transmission arm and the bottom plate. The door motor driving mechanism includes a motor and a synchronous belt, the motor and the arm shaft are linked with each other through the synchronous belt, the door motor driving mechanism will drive the arm shaft when operating, so as to cause the transmission arm to rotate around a hinged shaft. After the lift car door is opened, the front end of the stop arm will be stuck into the bayonet of the transmission arm, to keep the unlocked state of the lift car door. The first reset spring is disposed transversely, the transmission arm is restored to the initial position at the first reset spring, at this point, the draw bar is pressed down, and the two blades are in a clamped state.

As one preferred solution, the draw bar is disposed on the front of the bottom plate, a lower end of the draw bar is hinged with the upper rotating arm, an upper end of the draw bar extends to a position where the draw bar is opposite the transmission arm across the bottom plate, a first limit slot is opened on the bottom plate, and the upper end of the draw bar passes through the limit slot to be rotationally connected with the transmission arm. The connecting shaft is rotated to fit in with the first limit slot to limit the positions of the transmission arm and the draw bar. The transmission arm rotates to drive the draw bar to move up and down, and the draw bar drives the rotating arm to rotate about an axis.

As one preferred solution, a lower side of a front end of the lock plate has an inwardly concave arc edge used to lift up the lock plate, the upper unlock rotating arm abuts against the inwardly concave arc edge, a rear end of the lock plate extends to form a shifting portion, the front end of the lock plate is further provided with a lock tongue, the lock tongue is buckled with the lock hook on the lift car, and a second reset spring is further connected between an upper portion of the front end of the lock plate and the bottom plate. The second reset spring is a pressure spring, the second reset spring is vertically disposed above the lock plate, one end is connected to the upper portion of the lock plate, and one end is connected onto the bottom plate, to make the lock plate keep a pressed state.

As one preferred solution, the back of the bottom plate is further hinged with a manual unlock arm, a front end of the manual unlock arm is located on the shifting portion of the lock plate, the front end of the manual unlock arm is further provided with an unlock rope, and a third reset spring is connected between a rear end of the manual unlock arm and the bottom plate. The manual unlock arm can cause the car door lock to be opened manually, the unlock rope is pulled, to cause the front end of the manual unlock arm to be pressed down towards the shifting portion, the lock plate is driven to rotate around an axis, and the lock plate is disconnected from the lock hook, thereby achieving manual unlock.

As one preferred solution, a front end of the lock plate is further mounted with a switch pin, a car door is mounted with a bracket, the lock hook is mounted on the bracket, and the bracket is further mounted with a switch socket fitting in with the switch pin. The switch socket and the switch socket can indicate an ON/OFF state of the car door, when the car door is opened, the synchronous door knife is unlocked, the lock plate is lifted up, and the switch socket is separated from the switch pin.

As one preferred solution, the back of the stop arm is provided with a third limit shaft, a corresponding position of the bottom plate is provided with a second limit slot, the third limit shaft passes through the second limit slot to expose to the front of the bottom plate, and a fourth reset spring is connected between the third limit shaft and the bottom plate. The fourth reset spring is uprightly or obliquely disposed, an upper end of the fourth reset spring is connected onto the third limit shaft, a lower end is connected onto the bottom plate, and the fourth reset spring keeps a pressed state of the stop arm. The second limit slot limits a range of rotation of the limit shaft.

Therefore, the present invention has the following advantages: 1. a mechanical structure is simplified, only a first blade and a second blade are disposed, and functions of a door closing blade and an unlock blade are integrated onto the second blade; 2. as the second blade also has the function of the unlock blade, normal opening and closing of the door are not affected no matter how the landing door ball is offset-mounted or keeps far away, which reduces the requirement for precision of adjusting matching positions of a door knife and a landing door ball, to make debugging much easier; and 3. a problem that the door motor fails to work when the landing door ball is offset-mounted away from the unlock blade and a problem that the time is too long or crash occurs when mechanical reopening of the landing door is blocked at the end of door closing are solved at the same time.

1—bottom plate 2—upper rotating arm 2'—lower rotating arm 3—first blade 4—movable plate 5—second blade 6—upper unlock rotating arm 6'—lower unlock rotating arm 7—draw bar 8—stop arm 9—transmission arm 10—lock plate 11—connecting portion 12—first limit shaft 13—first reset spring 14—inwardly concave arc edge 15—rotating wheel 16—second reset spring 17—switch pin 18—arm shaft 19—bayonet 20—lock tongue 21—manual unlock arm 22—unlock rope 23—shifting portion 24—first limit slot 25—second limit slot 26—third limit shaft 27—fourth reset spring 28—second limit shaft 29—third reset spring

DETAILED DESCRIPTION OF PREFERRED EMBODIMENTS

The technical solution of the present invention is further described below through embodiments and in combination with the accompanying drawings.

Figure 1:
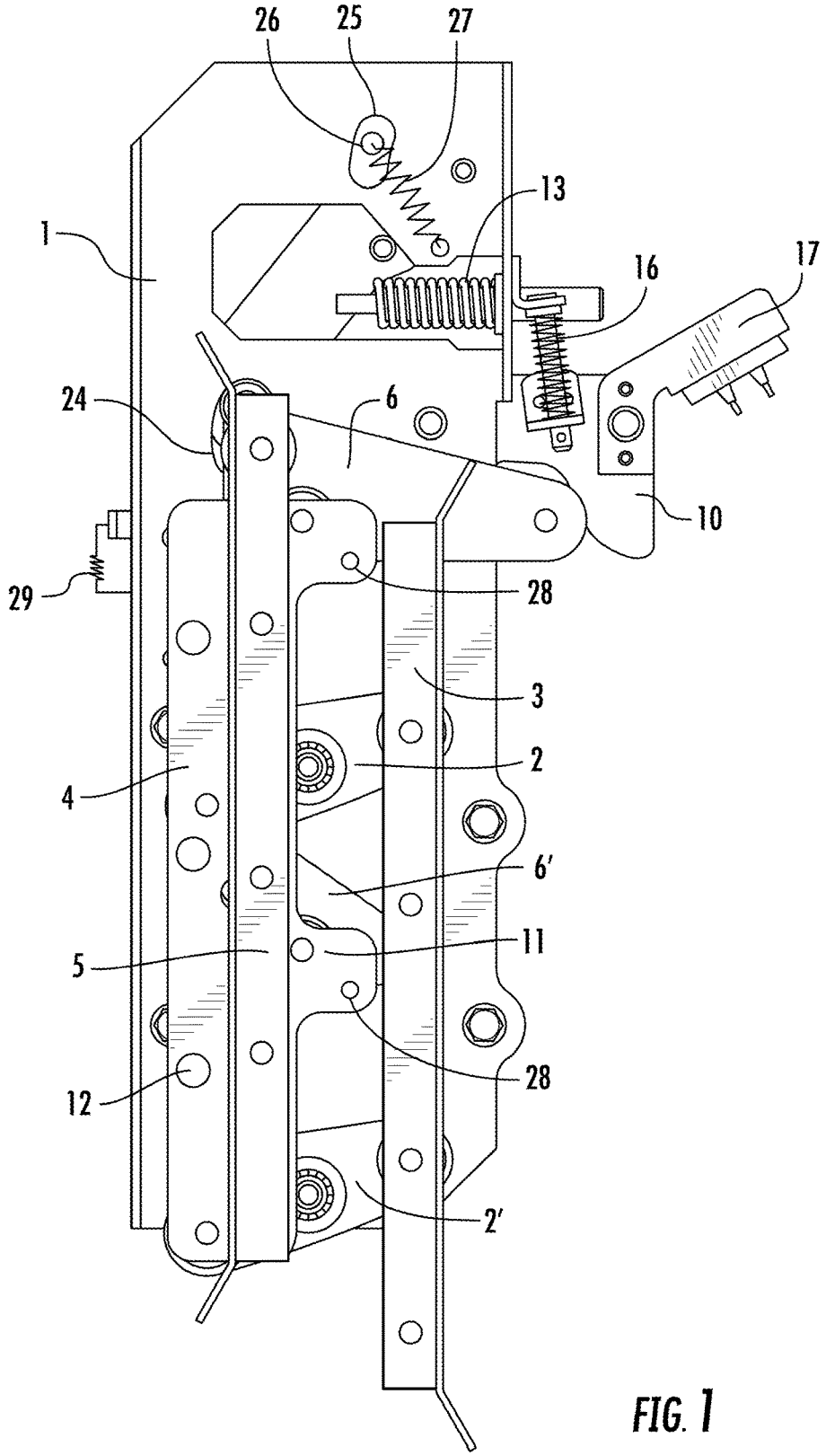
FIG. 1 is a schematic structural view of the front in the present invention.
Figure 2:
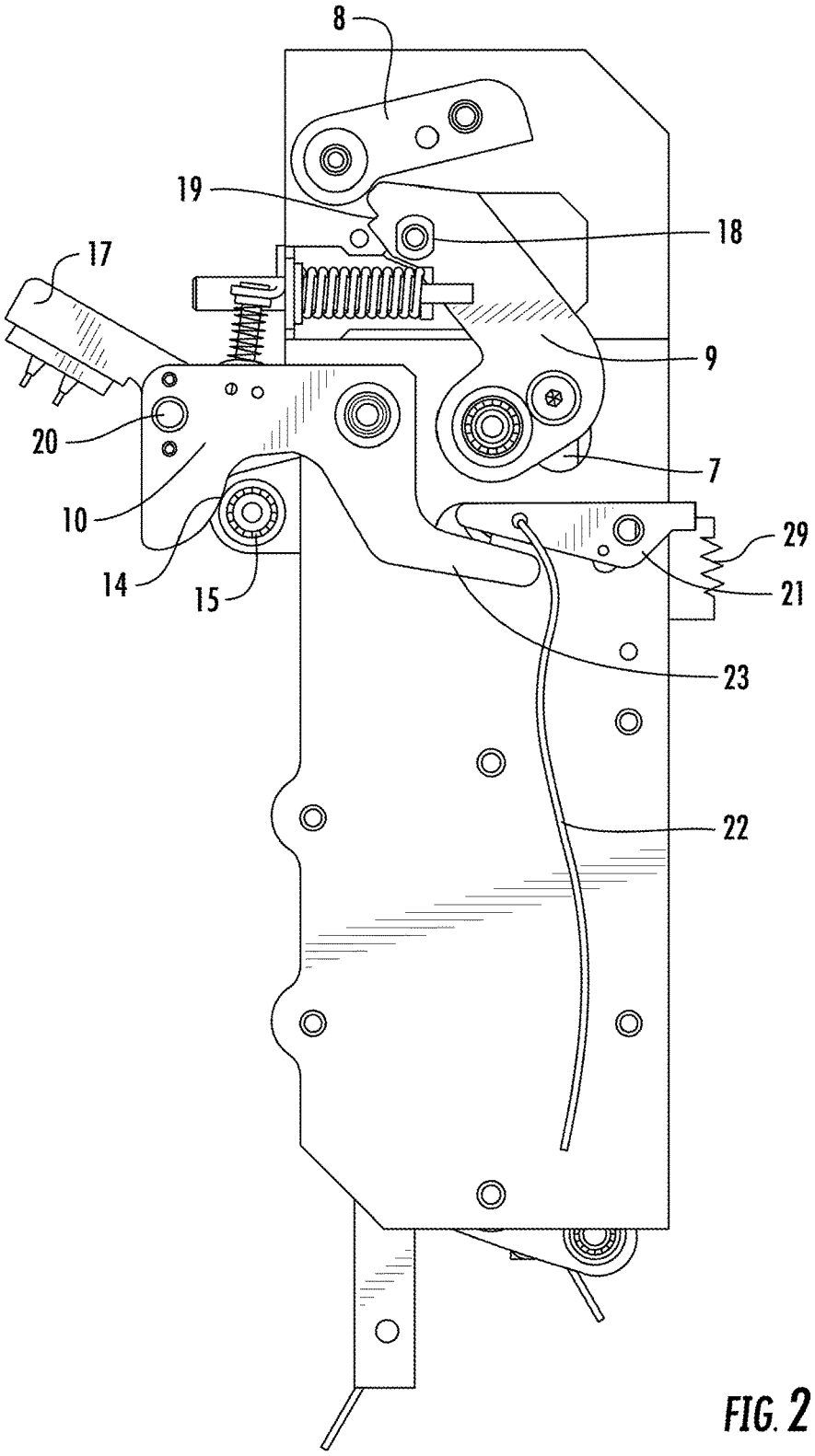
FIG. 2 is a schematic structural view of the back in the present invention.

This embodiment provides an elevator synchronous door knife, which, as shown in FIG. 1, includes a bottom plate 1 disposed on a hanging plate, wherein upper and lower portions of the front of the bottom plate are respectively rotationally connected with an upper rotating arm 2 and a lower rotating arm 2', right ends of the two rotating arms are rotationally connected with a first blade 3, and left ends of the two rotating arms are rotationally connected with a movable plate 4. The movable plate is rotationally connected with an upper unlock rotating arm 6 and a lower unlock rotating arm 6', and the upper unlock rotating arm and the lower unlock rotating arm are rotationally connected with a second blade 5. As shown in FIG. 2, the back of the bottom is rotationally connected with a stop arm 8, a transmission arm 9 linked with a door motor driving mechanism and a lock plate 10 buckled with a lock hook disposed on a lift car door motor. The upper rotating arm is linked with the transmission arm 9 through a draw bar 7.

An upper portion and a middle portion of one side of the movable plate towards the first blade project respectively to form connecting portions 11, the upper unlock rotating arm 6 and the lower unlock rotating arm 6' are respectively rotationally connected onto the two connecting portions, and second limit shafts 28 are disposed on the back of the two connecting portions. Specifically, left ends of the two rotating arms are respectively hinged to a middle portion and a lower portion of one side of the movable plate away from the first blade, and three first limit shafts 12 are disposed along edges on the front of the side of the movable plate.

Figure 3:
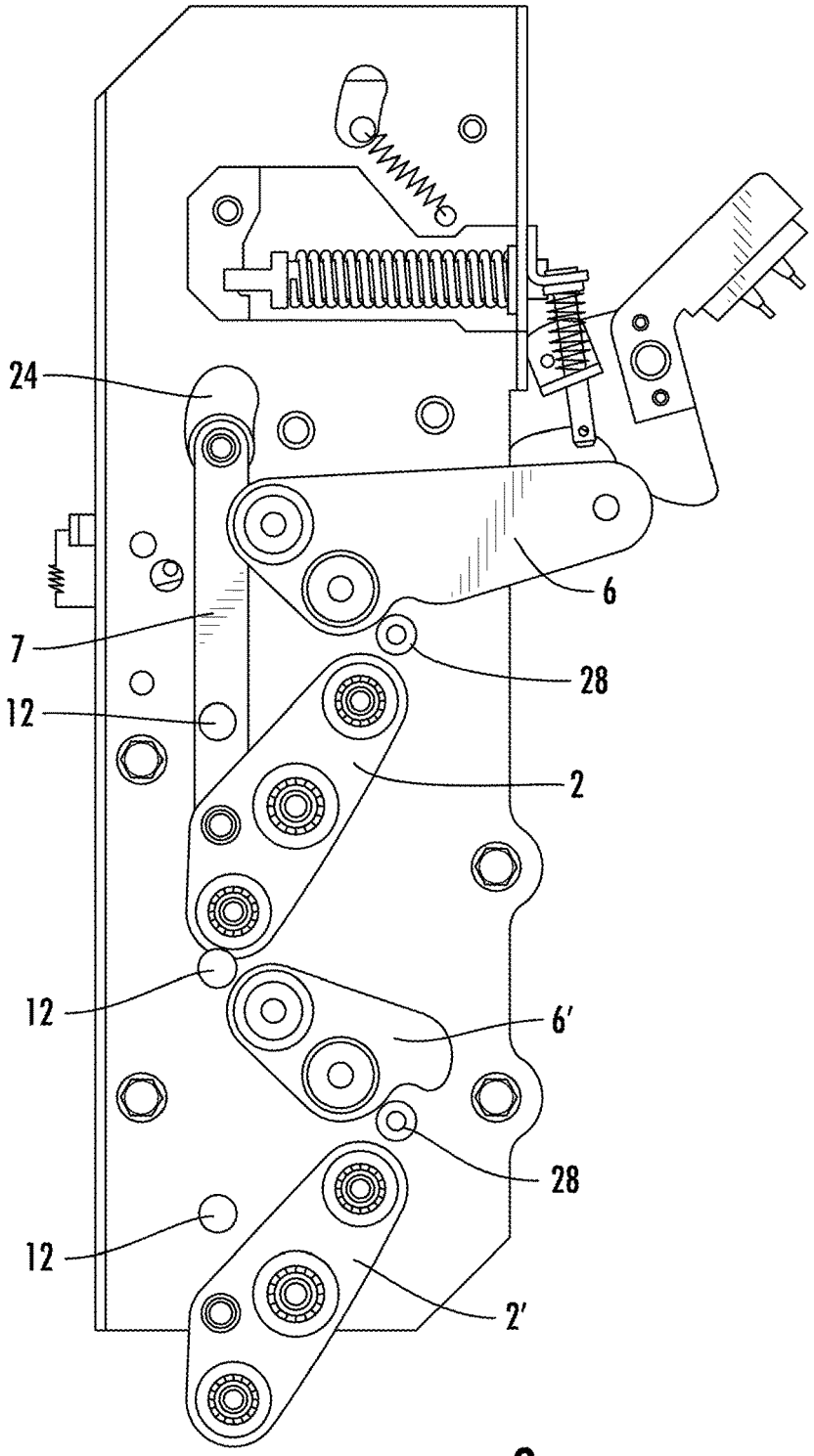
FIG. 3 is a schematic structural view after removal of a first blade, a second blade and a movable plate in the present invention.

As shown in FIG. 1 and FIG. 3, the upper unlock rotating arm and the lower unlock rotating arm are both in a shape of an inverted triangle, the connecting portions are rotationally connected onto vertex angles of the inverted triangles, the second blade 5 is rotationally connected onto a corner of the inverted triangles located on an inner side, that is, the left side in the figure, and the second blade is located on the upper portion of the movable plate. In addition, the other corner of the inverted triangle of the upper unlock rotating arm extends to the lock plate 10, a rotating wheel 15 is connected onto the corner, and the rotating wheel abuts against the lock plate.

As shown in FIG. 3, the draw bar 7 is disposed on the front of the bottom plate, the draw bar is vertically disposed, a lower end of the draw bar is rotationally connected onto the rotating arm 2 located on the upper portion, an upper end of the draw bar is located in a position where the draw bar is opposite the transmission arm 9 across the bottom plate, a first limit slot 24 is opened on the bottom plate, the first limit slot is arc-shaped, and the upper end of the draw bar passes through the limit slot to be rotationally connected with the transmission arm.

A front end of the stop arm 8 is provided with a guide wheel fitting in with the track frame, but the guide wheel and the track frame are not given in the figure. The track frame is mounted on the door motor back plate, the track frame includes two parts, i.e., a lifting track and a holding track, the lifting track and the holding track are transitionally connected with each other through an oblique track, the lifting track is located in the position where the car door is closed, and the guide wheel moves on the track frame. The back of the stop arm is provided with a third limit shaft 26, a corresponding position of the bottom plate is provided with a second limit slot 25, the third limit shaft passes through the second limit slot to expose to the front of the bottom plate, and a fourth reset spring 27 is connected between the third limit shaft and the bottom plate.

The transmission arm 9 is L-shaped, a rear end of the transmission arm is hinged to the back of the bottom plate, a front end of the transmission arm is provided with an arm shaft 18, and the arm shaft is linked with the door motor driving mechanism. The door motor driving mechanism includes a motor and a synchronous belt, the motor and the arm shaft are linked with each other through the synchronous belt, the door motor driving mechanism will drive the arm shaft when operating, so as to cause the transmission arm to rotate around an axis. A front end head of the transmission arm is provided thereon with a bayonet 19 buckled with the front end of the stop arm, a first reset spring 13 is connected between the front end of the transmission arm and the bottom plate, and the first reset spring is horizontally disposed.

The lock plate 10 is an irregular plate, a lower side of the front end of the lock plate has an inwardly concave arc edge 15 used to lift up the lock plate, and the rotating wheel of the unlock rotating arm abuts against the inwardly concave arc edge. A rear end of the lock plate extends to form a shifting portion 23, the front end of the lock plate is provided with a lock tongue 20, the lock tongue is buckled with the lock hook on the lift car, a second reset spring 16 is connected between an upper portion of the front end of the lock plate and the bottom plate, the second reset spring is a pressure spring, a lower end of the second reset spring is connected onto the lock plate, and an upper end is connected onto the bottom plate. A front end of the lock plate is further mounted with a switch pin 17, a lift car door motor hanging plate is mounted with a bracket, the lock hook is mounted on the bracket, and the bracket is mounted with a switch socket fitting in with the switch pin.

In order that manual unlock is possible in the case of failure, as shown in FIG. 2, the back of the bottom plate 1 is further hinged with a manual unlock arm 21, a front end of the manual unlock arm is located on the shifting portion 23 of the lock plate 10, the front end of the manual unlock arm is further provided with an unlock rope 22, and a third reset spring 29 is connected between a rear end of the manual unlock arm and the bottom plate.

Figure 4:
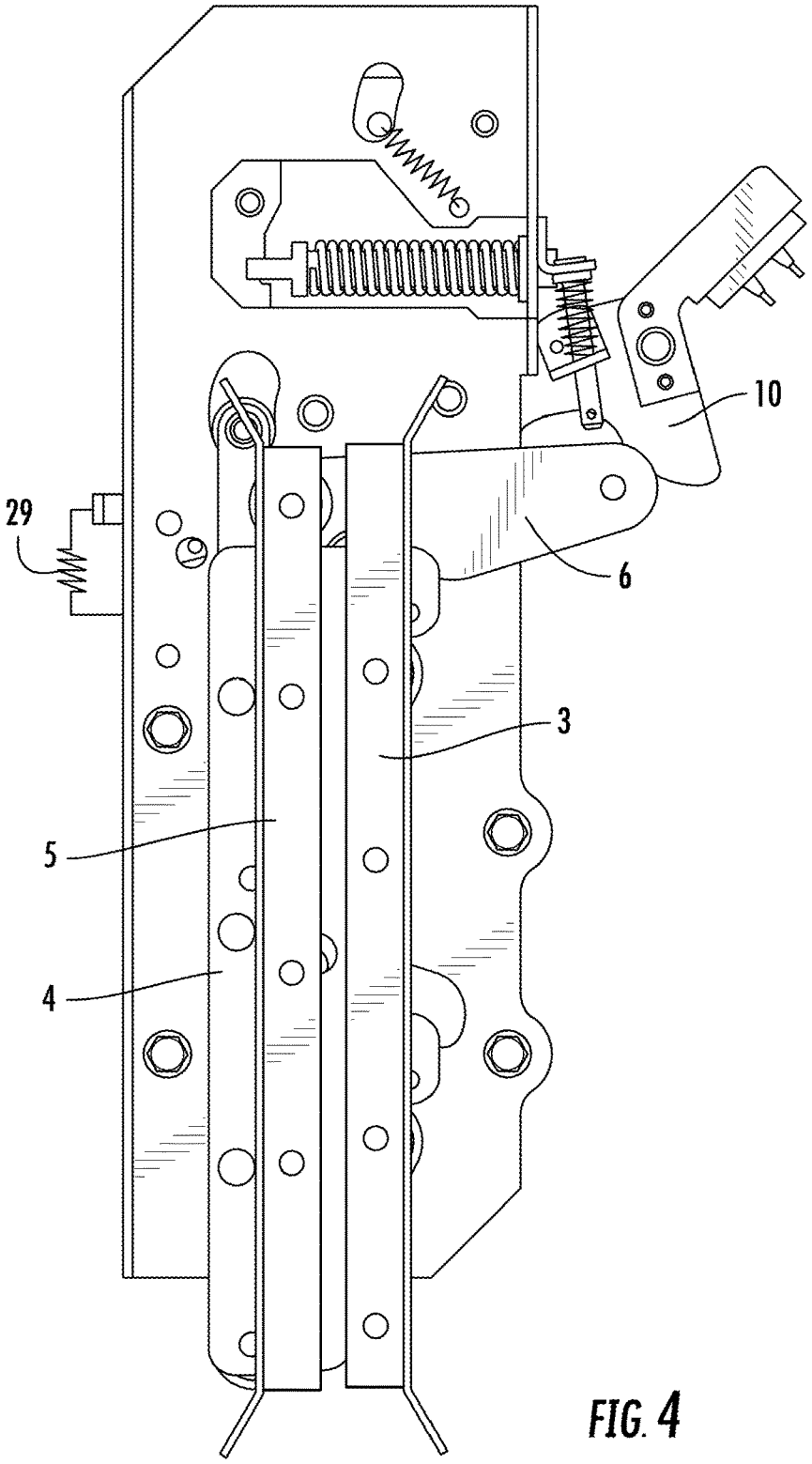
FIG. 4 is a schematic structural view of the front of an unlocked state in the present invention.

The process of normally opening a car door and a landing door is as follows: when the car door and the landing door are located at the same height, a landing door ball is located between the first blade and the second blade, which, as shown in FIG. 1 and FIG. 2, at this point, is in a closed state. As shown in FIG. 2, after the door motor driving mechanism operates, the arm shaft 18 is driven to move towards a door opening direction, and the transmission arm 9 rotates towards the door opening direction. As shown in FIG. 1, the transmission arm rotates to drive the draw bar to move downwards, the draw bar moves to drive the rotating arm to rotate counterclockwise, the first blade moves upwards to get close to the landing door ball, the movable plate moves downwards to get close to the landing door ball, the movable plate drives the unlock rotating arm connected therewith to make the same movement, and the unlock rotating arm also drives the second blade connected therewith to make the same movement and move downwards to get close to the landing door ball. During movement, the second blade gets close to the landing door ball and is blocked by the landing door ball, and thus it does not move to the right any more, while the movable plate continues to move to the lower right without contacting the landing door ball; in this way, under the driving of the second blade and the movable plate, one end of the unlock rotating arm in contact with the lock plate sticks up, to lift up the lock plate. The lock plate rotates, the lock tongue is disconnected from the lock hook, the switch socket is separated from the switch socket, as shown in FIG. 4 and FIG. 5, the unlock process is completed, and the car door and the landing door are opened.

Figure 5:
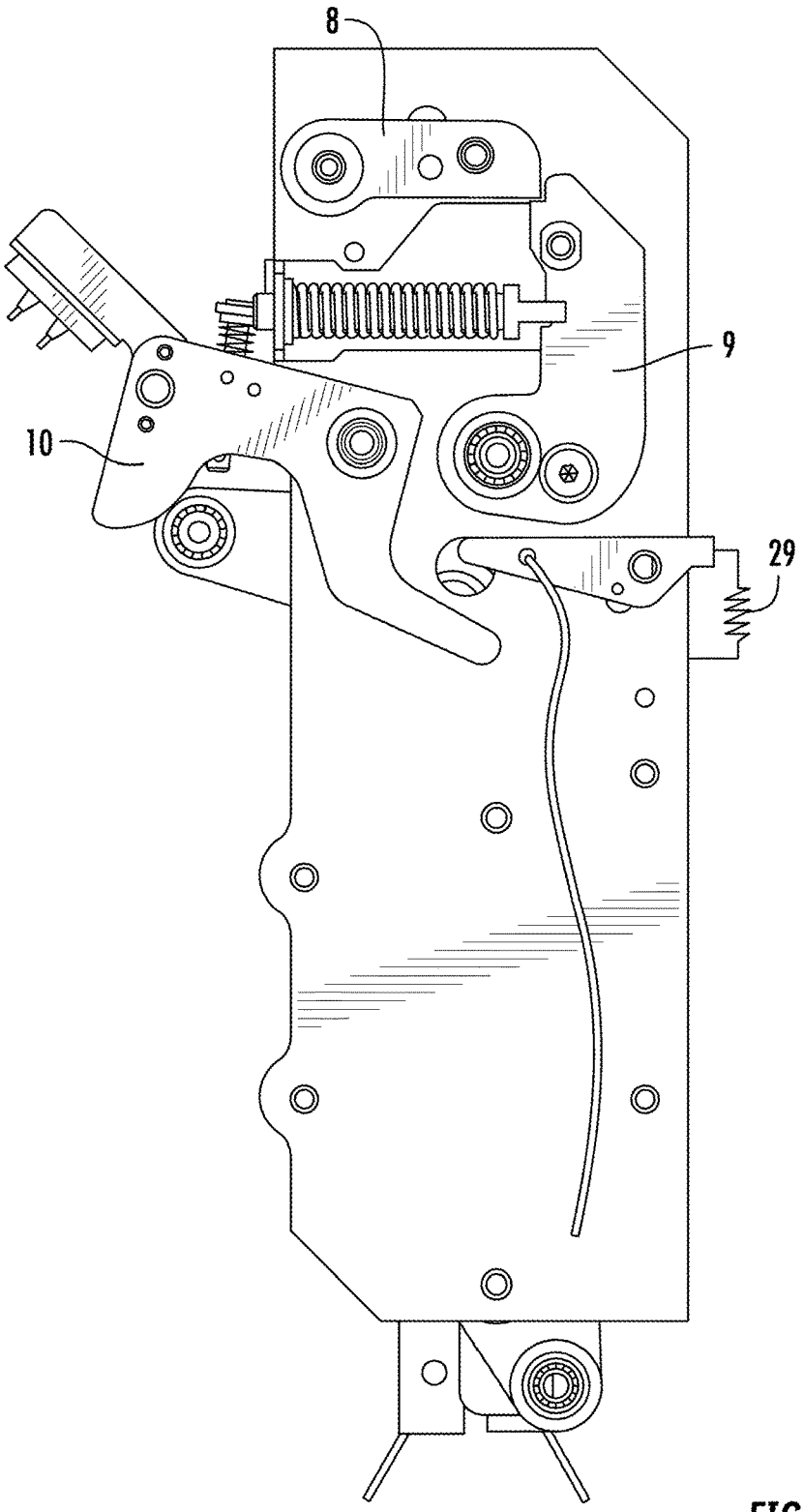
FIG. 5 is a schematic structural view of the back of the unlocked state in the present invention.

The process of normally closing the car door and the landing door is as follows: as shown in FIG. 5, the front end of the stop arm is stuck into the bayonet of the transmission arm, to keep an unlocked state, and the car door and the landing door are closed under the driving of a power mechanism. After closing is in place, at this point, the stop arm is lifted up under the action of the track frame, the front end of the stop arm is disconnected from the bayonet of the transmission arm, the transmission arm, under the driving of a door closing driving force, overcomes the first reset spring to move towards a door closing direction, to lift up the draw bar, the draw bar drives the rotating arm to rotate clockwise, the rotating arm drives the movable plate to move to the upper left, the movable plate drives the unlock rotating arm to move to the upper left, the unlock rotating arm drives the second blade to move to the upper left, the second blade leaves the landing door ball and is not blocked by the landing door ball, one end of the unlock rotating arm in contact with the lock plate falls, the lock plate is reset, the lock tongue is snapped into the lock hook and is restored to the state in FIG. 1 and FIG. 2, and locking is completed.

In the event of elevator failure, the car door and the landing door are not located at the same height, at this point, the landing door ball is not between the first blade and the second blade, if the door motor is normal, at this point, the car door lock is in a tightly locked state, and passengers cannot push the car door aside in the lift car. If the door motor loses electricity, the door knife will, under the action of the first reset spring, carry out a process similar to the process of normally opening the car door and the landing door, only because there is no landing door ball, the second blade is not blocked during movement, and moves to the lower right like the movable plate, the unlock rotating arm also moves to the lower right but does not make rotation, the lock plate keeps still, unlocking cannot be carried out, and the passengers still cannot push the card door aside in the lift car.

In the event of elevator failure, the car door and the landing door are not located at the same height, and when it is necessary to open the car door, the unlock rope is pulled manually, so that the lock plate rotates, the front end of the lock plate sticks up, the lock tongue is disconnected from the lock hook, manual unlock is completed, and the car door is opened.

Specific embodiments described herein are merely illustrations for the spirit of the present invention. Those skilled in the art can make various modifications or supplements to the specific embodiments described or replace the specific embodiments in a similar manner, which will not depart from the spirit of the present invention or go beyond the scope defined by the appended claims.

Although terms such as bottom plate, upper rotating arm, first blade, movable plate and second blade are used frequently herein, the possibility of use of other terms is not ruled out. Use of the terms is merely intended to describe and explain the essence of the present invention more conveniently; and explaining them as any additional limitation is against the spirit of the present invention.

The invention claimed is:

1. An elevator synchronous door knife, comprising a track frame disposed on a door motor back plate and a bottom plate disposed on a hanging plate, wherein the back of the bottom plate is hinged with a stop arm, a transmission arm linked with a door motor driving mechanism and a lock plate buckled with a lock hook disposed on a lift car, a front end of the stop arm is provided with a guide wheel fitting in with the track frame, and upper and lower portions of the front of the bottom plate are respectively rotationally connected with an upper rotating arm and a lower rotating arm, characterized in that: the upper rotating arm (2) is linked with the transmission arm (9) through a draw bar (7), one end of the upper rotating arm (2) and the lower rotating arm (2') is rotationally connected with a first blade (3), the other end of the upper rotating arm and the lower rotating arm is rotationally connected with a movable plate (4), to form a four-bar linkage, upper and lower portions of the movable plate are respectively rotationally connected with an upper unlock rotating arm (6) and a lower unlock rotating arm (6'), the upper unlock rotating arm and the lower unlock rotating arm are movably connected with a second blade (5), and the upper unlock rotating arm further abuts against the lock plate (10) to drive the lock plate to be unlocked or locked up.

2. The elevator synchronous door knife according to claim 1, characterized in that: in a horizontal direction, a sequence of positions from the first blade to the second blade is kept consistent with a door opening direction.

3. The elevator synchronous door knife according to claim 1, characterized in that: the movable plate (4) is located below the second blade, an upper portion and a middle portion of one side of the movable plate towards the first blade (3) project respectively to form connecting portions (11), the other side of the movable plate is provided with several first limit shafts (12) along an edge, the upper unlock rotating arm (6) and the lower unlock rotating arm (6') are respectively rotationally connected onto the two connecting portions, the connecting portions are further provided thereon with second limit shafts (28), and the upper rotating arm (2) and the lower rotating arm (2') are respectively rotationally connected onto a middle portion and a lower portion of one side of the movable plate away from the first blade.

4. The elevator synchronous door knife according to claim 3, characterized in that: the upper unlock rotating arm (6) and the lower unlock rotating arm (6') are both in a shape of an inverted triangle, the connecting portions (11) are rotationally connected onto vertex angles of the inverted triangles, the second blade (5) is rotationally connected onto a comer of the inverted triangles located on an inner side, the other comer of the inverted triangle of the upper unlock rotating arm (6) extends to the lock plate (10), a rotating wheel (15) is connected onto the comer, and the rotating wheel is in contact with the lock plate.

5. The elevator synchronous door knife according to claim 1, characterized in that: the transmission arm (9) is L-shaped, a rear end of the transmission arm is hinged to the back of the bottom plate (1), a front end of the transmission arm is provided with an arm shaft (18), the arm shaft is linked with the door motor driving mechanism, a front end head of the transmission arm is provided thereon with a bayonet (19) buckled with the front end of the stop arm (8), and a first reset spring (13) is connected between the front end of the transmission arm and the bottom plate.

6. The elevator synchronous door knife according to claim 1, characterized in that: the draw bar (7) is disposed on the front of the bottom plate, a lower end of the draw bar is hinged with the upper rotating arm, an upper end of the draw bar extends to a position where the draw bar is opposite the transmission arm (9) across the bottom plate, a first limit slot (24) is opened on the bottom plate, and the upper end of the draw bar passes through the limit slot to be hinged with the transmission arm.

7. The elevator synchronous door knife according to claim 1, characterized in that: a lower side of a front end of the lock plate (10) has an inwardly concave arc edge (14) used to lift up the lock plate, the upper unlock rotating arm (6) abuts against the inwardly concave arc edge, a rear end of the lock plate extends to form a shifting portion (23), the front end of the lock plate is further provided with a lock tongue (20), the lock tongue is buckled with the lock hook on the lift car, and a second reset spring (16) is further connected between an upper portion of the front end of the lock plate and the bottom plate (1).

8. The elevator synchronous door knife according to claim 7, characterized in that: the back of the bottom plate (1) is further hinged with a manual unlock arm (21), a front end of the manual unlock arm is located on the shifting portion (23) of the lock plate (10), the front end of the manual unlock arm is further provided with an unlock rope (22), and a third reset spring (29) is connected between a rear end of the manual unlock arm and the bottom plate.

9. The elevator synchronous door knife according to claim 1, characterized in that: a front end of the lock plate (10) is further mounted with a switch pin (17), a car door is mounted with a bracket, the lock hook is mounted on the bracket, and the bracket is further mounted with a switch socket fitting in with the switch pin.

10. The elevator synchronous door knife according to claim 1, characterized in that: the back of the stop arm (8) is provided with a third limit shaft (26), a corresponding position of the bottom plate (1) is provided with a second limit slot (25), the third limit shaft passes through the second limit slot to expose to the front of the bottom plate, and a fourth reset spring (27) is connected between the third limit shaft and the bottom plate.

* * * * *